US005737811A

United States Patent [19]

Rashid

[11] Patent Number: 5,737,811

[45] Date of Patent: Apr. 14, 1998

[54] ARTICLE FOR FASTENING OF EYELET SHOES

[76] Inventor: Haroon Rashid, 72 Van Reipen Ave., Apt. #280, Jersey City, N.J. 07306

[21] Appl. No.: 781,371

[22] Filed: Jan. 21, 1997

[51] Int. Cl.[6] ..... A43C 1/00

[52] U.S. Cl. ..... 24/713; 24/713.6; 24/713.1; 24/573.1

[58] Field of Search ..... 24/573.1, 713, 24/713.6, 715.3, 114.9, 66.2, 66.4, 50, 68 J, 71 J, 116 A, 713.1

[56] References Cited

U.S. PATENT DOCUMENTS

| | | | |
|---|---|---|---|
| 39,163 | 7/1863 | Newton | 24/713.6 |
| 494,825 | 4/1893 | Spicer | 24/573.1 |
| 1,772,673 | 8/1930 | MacDonald | 24/713 |
| 2,289,225 | 7/1942 | Tonai | 24/713 |
| 2,574,579 | 11/1951 | McCoy et al. | 24/116 A |
| 3,385,050 | 5/1968 | Hall | 24/116 A |
| 3,439,439 | 4/1969 | Stimson | 24/114.9 |
| 4,229,930 | 10/1980 | Ostermaier | 24/573.1 |
| 4,296,515 | 10/1981 | Hauser | 24/713 |
| 5,239,732 | 8/1993 | Steven | 24/573.1 |

*Primary Examiner*—Victor N. Sakran
*Attorney, Agent, or Firm*—M. K. Silverman

[57] ABSTRACT

An article for the fastening of shoes having successive horizontal pairs of eyelets. includes an elongate, preferably elastic, cord having first and second ends, and substantially T-shaped elements or barbs secure each end of the cord. Each T-shaped element is proportioned for snap-fit passage through the eyelets of such shoes. One stop element is secured inwardly of each T-shaped element, and proximally to it, at each of end of the elongate cord. Each eyelet of the shoe is secured inwardly of one T-shaped element and outwardly of one stop element, and is in pressure contact with both. The elastic tension of the elongate cord, in combination with the above-described action of the T-shaped and stop elements relative to each eyelets, operates to fasten successive horizontal pairs of eyelets of a shoelace type shoe to effect the closure of the shoe.

9 Claims, 2 Drawing Sheets

ARTICLE FOR FASTENING OF EYELET SHOES

BACKGROUND OF THE INVENTION

The art of fastening shoes having successive horizontal pairs of eyelets is limited. In that the provision of pairs of eyelets along opposing edges of the mouth of a shoe was originally a consequence of the use of shoelaces to fasten the shoe, it is not surprising that there exists little prior art directed to the use of means, other than shoelaces, to affect the fastening or closure of the mouth of a shoelace type shoe about the foot of a user.

To the knowledge of the inventor, the only prior art which shows the use of non-shoelace means to secure the mouth of a shoelace type shoe are U.S. Pat. No. 2,289,225 (1942) to Tonai, and French Patent Nos. 608,938 (1925) and 610,212 (1926). The teachings of these references show eyelet pair securing means having structures, and functions which differ materially from those set forth in the invention described herein.

SUMMARY OF THE INVENTION

The present invention relates to an article for the fastening of shoes having successive horizontal pairs of eyelets. The article more particularly comprises an elongate, preferably elastic, cord having first and second ends thereof and substantially T-shaped elements or barbs secure each end of said cord. Each T-shaped element is proportioned for snap-fit passage thereof through said eyelets of such shoes. One stop element is secured inwardly of each T-shaped element, and proximally thereto, at each of end of said elongate cord. Each eyelet of the shoe is thereby secured inwardly of one T-shaped element and outwardly of one stop element, and is in pressure contact with both. The elastic tension of said elongate cord, in combination with the above-described action of the T-shaped and stop elements relative to each eyelets, operates to fasten successive horizontal pairs of eyelets of a shoelace type shoe to effect the closure thereof.

It is accordingly an object of the present invention to provide a means for the fastening of shoelace type shoes without use of shoelaces.

It is another object to provide an article of the above type for the fastening of shoes having successive horizontal pairs of eyelets.

It is a further object of the invention to provide an article of the above type adapted for the securement of ornamental objects such as jewelry, charms, beads and the like thereon.

It is a still further object to provide an article of the above type in which such ornamental articles may be selectably changed by a user thereof.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
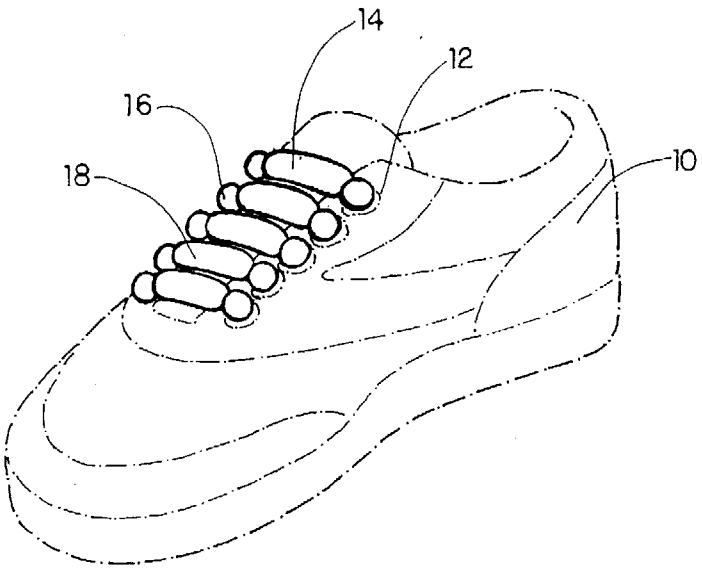
FIG. 1 is a perspective view of a shoe fastening system in accordance with the present invention.

With reference to the perspective view of FIG. 1, there is shown in phantom a shoe 10 of a type having successive horizontal pairs of eyelets 12. Shown in position upon such successive pairs of eyelets is an article 14 which is the subject matter of the invention, as is more fully set forth below.

Figure 2:
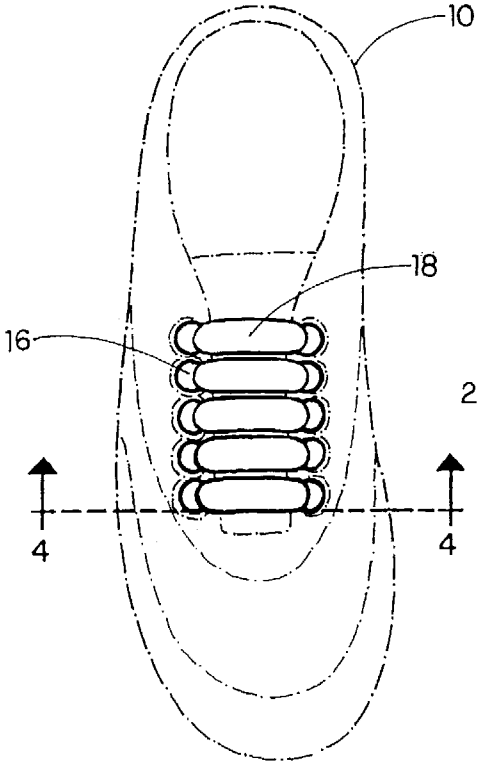
FIG. 2 is a top plan view thereof.

As may be noted therein and, as well, from the top view of FIG. 2, the most noticeable external features of the inventive article for fastening of shoelace type shoes are stop elements 16 and a central segment which any of a variety of ornamental means, as is set forth below, may be affixed.

Figure 3:
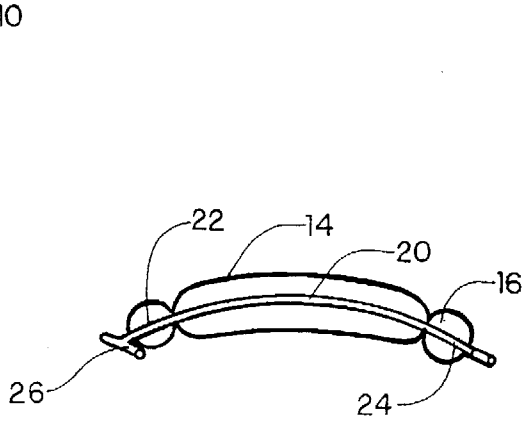
FIG. 3 is a front elevational view of the inventive article including an ornamental object attached to a central portion thereof.
Figure 4:
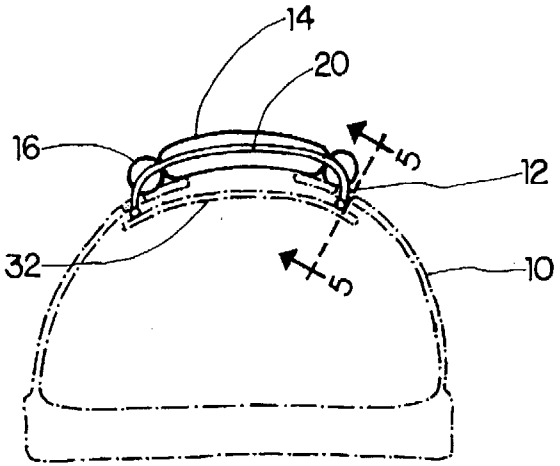
FIG. 4 is a vertical cross-sectional view taken through Line 4—4 of FIG. 2.

With reference to the views of FIGS. 3 and 4, the present inventive article may, more particularly, be seen to include an elongate, preferable elastomeric, cord 20 having a first end 22 and a second end 24.

Figure 5:
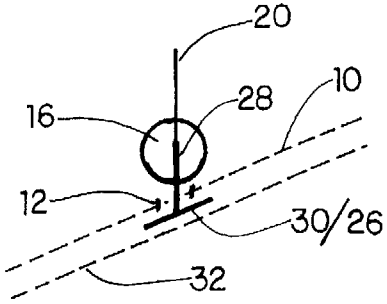
FIG. 5 is a side cross-sectional schematic view taken along Line 5—5 of FIG. 4.

Disposed at each of said ends 22 and 24 respectively of cord 20 are substantially T-shaped elements 26 which are proportioned for slip-fit passage through said eyelets 12 of the shoe 10. Each T-shaped element 26 more particularly comprises an axial segment 28 (see cross-sectional view of FIG. 5) which is substantially co-linear with a longitudinal axis of said elongate cord 20, and is secured thereto, Integrally and transversely dependent from said axial segment 28 is a transverse end piece 30 of the T-shaped element 26. The axis of said transverse piece is preferably tilted at an angle in the range of 15 to 45 degrees relative to the axis of said axial segment 28, the purpose thereof being to assure that the transverse piece 30 will be ergonomically compatible with the curvature of the human foot. That is, the axis of transverse segment 30 will, when inserted in the position shown in FIGS. 4 and 5, be located inside of the eyelet 12 of the shoe and above the tongue 32 thereof. Accordingly, both the tilt of transverse piece 30, and its position above tongue 32 assures that the T-shaped element will not impart any discomfort to the user thereof. Further shown in FIGS. 4 and 5 is said stop element 16 which, as may be noted, is positioned proximally to the T-shaped element 26. In a preferred embodiment of the invention, the axial segment 28 is embedded within the stop element 16, after it has been secured to an end of elastic cord 20 by means of crimping or equivalent means to assure a rigid and stable connection between the T-shaped element and the stop element.

It is to be appreciated that, resultant of the above structure, the present article, when positioned within an eyelet shoe, will exhibit the stop element 16 upon an inner side of the eyelet 12 and the transverse piece 30 of each T-shaped element 26 upon the outer side thereof. There will accordingly exist a snug fit of each eyelet 12 between the stop and T-shaped elements of the instant invention. Further, cord 20 will provide an elastomeric tension between the ends 22 and 24 of the cord 20, thereby providing the fastening function to the system.

It is noted that T-shaped element 26 may also be termed a barb-like element because of the tilt of the transverse piece 30 thereof relative to the axial segment 28. It is noted that the T-shaped element may be formed of either a metallic or plastic material.

Figure 6:
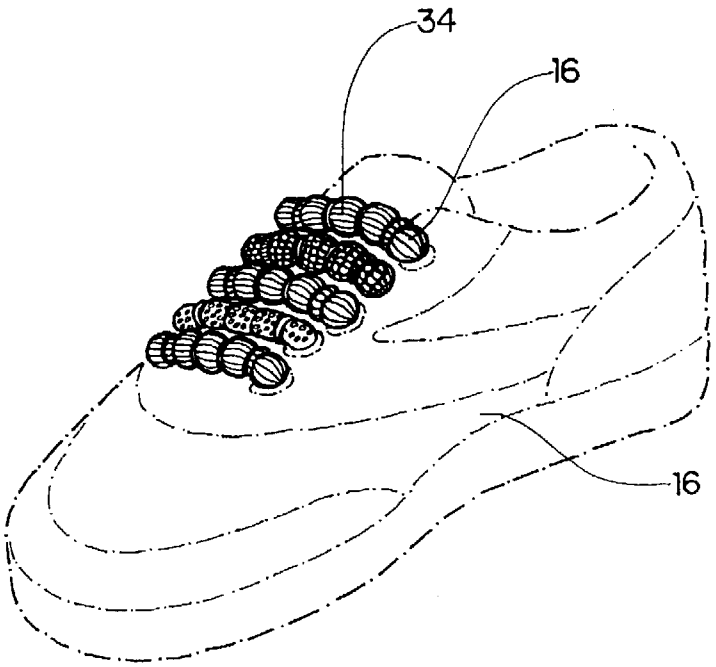
FIG. 6 is a perspective view, similar to the view of FIG. 1, however showing the use of ornamental beads in connection with the inventive article in lieu of the unitary ornamental elements shown in said FIG. 1.

It is to be also understood that, consequential of the above-described article for fastening of shoes having successive horizontal pairs of eyelets, there is provided a system for affixing a variety of ornamental elements within the central segment 14 of each of the articles. These bear the marketing term T-LACES. That is, upon each T-LACE may be placed any of a wide variety or ornamental means, this including beads 34 of the type shown in FIG. 6 and cartoon-like characters. Such ornamental elements may either be threaded upon the cord 20 prior to the affixation of the T-shaped elements at the ends thereof or, where removability of the ornamental elements is desired, such means may be provided with holes, grooves, channels or notches to permit slidable affixation or removal of such elements onto and from the cord 20.

It is to be further appreciated that the T-LACES are readily removable from the shoe so that, as a practical matter, a user thereof can simply exchange a T-LACE which has been provided with one ornamental theme for another T-LACE having a different theme. Also, such ornamental T-LACES may be "mixed and matched" in accordance with the fancy of the user. Thereby, the instant system defines a means of elevating shoelaces to the level of a form of jewelry, while also affording the functional benefit of an alternate form of shoelace for an eyelet type of shoe. As such, the instant T-LACE replaces normal shoelaces and act as an alternative elastic fastening means thereof.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus describe my invention what I claim as new, useful and non-obvious and, accordingly, secure by Letters Patent of the United State is:

1. An Article for the fastening of shoes having successive horizontal pairs of eyelets, the article comprising:

(a) an elastomeric cord having an inwardly directed tension, and further having first and seconds ends thereof, said cord proportioned in length to a transverse distance between each eyelet pair;

(b) substantially T-shaped elements secured to each of said ends of said cord, each of said elements proportioned for slip-fit passage thereof through said eyelets of said shoes; and (c) stop elements secured inwardly of each T-shaped element at each of said ends of said elastomeric cord, said stop elements located at a dimension relative to said T-shaped elements proportioned to the width of each eyelet of each of said successive horizontal pairs thereof.

2. The article as recited in claim 1, in which a segment of said cord between opposing stop elements thereof defines means for securement of ornamental elements thereto.

3. The article as recited in claim 2, in which said securement means comprises:

means for selectable detachable securement.

4. The article as recited in claim 2, in which said stop elements comprise substantially spherical bodies.

5. The article as recited in claim 2, in which said T-shaped elements each comprises:

(i) an axial segment secured to each end of said cord substantially co-linear with a longitudinal axis of said cord; and (ii) an integral end piece depending transversely from said axial segment in a direction substantially co-linear with an axis defined by a proximal one row of successive pairs of eyelets.

6. The article as recited in claim 5, in which said integral end piece defines a barb-like element.

7. The article as recited in claim 5, in which each of said end piece defines an angle in a range of between 15 and 45 degrees relative to said axial segment of each T-shaped element.

8. The article as recited in claim 5, in which said ornamental elements comprise bead-like elements.

9. The article as recited in claim 5, in which said ornamental element comprise jewelry

* * * * *